US010731359B2

(12) United States Patent
Hering et al.

(10) Patent No.: US 10,731,359 B2
(45) **Date of Patent: *Aug. 4, 2020**

(54) MODULAR SPRUNG FLOOR

(71) Applicants: Spencer Gavin Hering, Miami, FL (US); Manuel Reyes, Newport, RI (US)

(72) Inventors: Spencer Gavin Hering, Miami, FL (US); Manuel Reyes, Newport, RI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/407,348

(22) Filed: May 9, 2019

(65) Prior Publication Data

US 2020/0190830 A1 Jun. 18, 2020

Related U.S. Application Data

(63) Continuation-in-part of application No. 15/967,519, filed on Apr. 30, 2018, now Pat. No. 10,329,777.

(51) Int. Cl.
*E04F 15/22* (2006.01)
*E04F 15/04* (2006.01)

(52) U.S. Cl.
CPC ..... *E04F 15/225* (2013.01); *E04F 15/04* (2013.01)

(58) Field of Classification Search
CPC ..... E04F 15/225; E04F 15/04
USPC ..... 52/403.1
See application file for complete search history.

(56) References Cited

U.S. PATENT DOCUMENTS 1,789,576 A * 1/1931 Bowman ..... E04F 15/14 52/318
3,142,367 A * 7/1964 Brown ..... E04B 9/068 52/506.07
4,443,989 A * 4/1984 Silvey ..... E04F 15/22 52/393
4,854,099 A * 8/1989 Kristoffersen ..... E04F 15/18 52/403.1
5,581,965 A * 12/1996 Jørgensen ..... E04F 15/22 52/403.1
5,727,354 A * 3/1998 Clement ..... E04F 13/0803 52/387
6,684,593 B2 * 2/2004 Brenneis ..... B64C 1/12 244/119
7,159,822 B2 * 1/2007 Grantham ..... B64C 1/12 244/119
8,628,427 B2 * 1/2014 Koberinski ..... E04B 5/43 472/92
9,604,428 B2 * 3/2017 Walker ..... B29D 24/002
(Continued)

FOREIGN PATENT DOCUMENTS

EP 1231336 A1 * 8/2002 ..... E04F 15/225
KR 2017004274 U * 12/2017 ..... A01K 61/00

*Primary Examiner* — Jeanette E Chapman
(74) *Attorney, Agent, or Firm* — Keeley DeAngelo LLP; W Scott Keeley

(57) ABSTRACT

In accordance with example embodiments of the present disclosure, a method, system and apparatus for a modular sprung-floor is disclosed. An example embodiment is a sprung floor module having interchangeable components. Interchangeable components make up standardized assemblies. An example embodiment has a frame module that may be installed in a series to cover a given area. The frame and edge modules comprise a frame that supports a performance surface. Standardized components include fiber-reinforced composite linear-structural members combined with elastomeric joints and support members.

4 Claims, 18 Drawing Sheets

(56) References Cited

U.S. PATENT DOCUMENTS

| | | | | |
|---|---|---|---|---|
| 10,196,825 | B2 * | 2/2019 | Gosling | E04F 15/02494 |
| 10,329,777 | B2 * | 6/2019 | Hering | E04F 15/22 |
| 2002/0189184 | A1 * | 12/2002 | Shelton | E04F 15/225<br>52/403.1 |
| 2007/0157536 | A1 * | 7/2007 | Foss | E04B 9/064<br>52/506.07 |
| 2011/0051320 | A1 * | 3/2011 | Miller | H01G 9/02<br>361/524 |
| 2011/0099931 | A1 * | 5/2011 | Lee | E04F 15/04<br>52/403.1 |
| 2011/0192096 | A1 * | 8/2011 | Koberinski | E04B 5/43<br>52/126.6 |

* cited by examiner

100

114

114

124

132

130

200

200

232

230

332

330

MODULAR SPRUNG FLOOR

This application is a continuation-in-part application of U.S. patent application Ser. No. 15/967,519 filed 2018 Apr. 30.

TECHNICAL FIELD

The present disclosure relates to modular floor systems and impact and shock-absorbing floors.

BACKGROUND

A sprung floor is a floor that is designed to absorb impact or vibration. Such floors are used for dance and indoor sports, martial arts and physical education to enhance performance and reduce injury. Impact injuries and repetitive stress injuries are mitigated by sprung floors.

Sprung-floor requirements are similar for dance or sports. Aspects of sprung floors include: stability; balance; flatness; flexion to prevent injuries without being so soft as to cause fatigue; sufficient traction to avoid slipping without causing one's foot to twist due to excessive grip.

Common construction methods include woven slats of wood or wood with high-durometer rubber pads between the wood and sub-floor, or a combination of the woven slats with rubber pads. Some sprung floors are constructed as permanent structures while others are composed of modules that slot together and can be disassembled for transportation. When constructed, a gap is left between the sprung floor and walls to allow for expansion and contraction of the sprung-floor materials.

The surface of a sprung floor is referred to as the performance surface and may be constructed of either a natural material such as solid or engineered wood or may be synthetic such as vinyl, linoleum or other polymeric construction. The surface upon which a sprung floor is installed is referred to as the sub-floor.

Some pads or shock absorbers used in sprung-floor construction are made of rubber or elastic polymers. The term elastic polymer is commonly referred to as rubber. Elastomers are amorphous polymers having viscosity and elasticity with a high failure strain compared to other polymers. Rubber is a naturally occurring substance that is converted into a durable material through the process of vulcanization. Elastomers or elastomeric materials may be thermosets or thermoplastic. A thermoset material is formed and set with a heating process. Thermoset materials do not return to their liquid state upon re-heating. Thermoplastic materials return to a liquid state when subject to sufficient heat. Thermoplastic materials may be injection-molded while thermoset materials are commonly molded in low-pressure, foam-assisted molds or are formed in stock material that may be die-cut or machined.

Bending stiffness, also referred to as flexural rigidity, may be understood to be the result of a material's elastic modulus (E) multiplied by the area moment of inertia (I) of a beam cross-section, E*I. Bending stiffness or flexural rigidity may be measured in Newton millimeters squared (N*mm^2) A beam is also referred to as an elongate member.

SUMMARY

In accordance with example embodiments of the present disclosure, a method, system and apparatus for a modular sprung-floor is disclosed. An example embodiment is a sprung floor module having interchangeable components.

Interchangeable components make up standardized assemblies. An example embodiment has a frame module that may be installed in a series to cover a given area along with an edge module that provides a finished edge to the frame modules. The frame and edge modules comprise a frame that supports a performance surface.

Standardized components include linear structural members combined with elastomeric joints and support members. Linear structural members may be hollow rectangular tubes.

One skilled in the art is familiar with hollow rectangular structural members made of steel, aluminum, fiber-reinforced polymers and the like. Manufacturing methods include casting, extruding, pultrusion, laminate molding and the like. Material properties vary as to cost of materials and are dependent on specific aspects of applications. For example, fiber-reinforced structural members may be appropriate for a modular system that must be rapidly assembled, disassembled and moved, whereas a permanent installation may utilize wood, composite, polymer, aluminum or steel structural members for reasons of durability and cost.

Frame modules are made up of linear-structural members arranged in a grid pattern having X-axis members and Y-axis members. Vertical joints are standardized components of an elastomeric material that join linear-structural members at right angles where X-axis members meet Y-axis members. These joints join structural members to form a frame while damping vibration and impact.

Other elastomeric members engage with X-axis or Y-axis members and further join together lateral channels that support a performance surface. The performance surface is made up of flat panels that are keyed together. These lateral channels join together frame modules while aligning and connecting performance surface panels, and in some embodiments have a U-shaped cross section. In some embodiments, performance-surface panel joints do not align with frame-module joints. Lateral channels provide a way of joining together performance-surface panels across frame module seams. Elastomeric supports between frame modules and linear channels damp vibrations between performance surface panels and frame modules.

An edge assembly provides a finished edge to the modular floor assembly. In one embodiment, an edge assembly is a long, linear structural member that resides along the Y axis of an assembled frame. Relatively short structural members along the X axis are joined perpendicularly to the long Y-axis members. Their distal ends are further joined to frame members coaxially (i.e., continuing along the X axis). A lateral support structure is affixed to the edge assembly by an array of elastomeric joint-members that join linear-structural members at right angles while also supporting the lateral channel and damping vibrations between the lateral channel, and hence the performance surface, and the edge-assembly structure.

To join grid modules together, elastomeric pads and brackets are installed to abutting elongate members, forming a lateral joint. The elastomeric pads transmit load from a performance surface perpendicularly to these joints.

The perpendicular force transmits a compressive force on the top of the elongate members, and a tensile force on the bottom of the elongate members. The tops of the abutting elongate members push into each other, supporting the compressive load.

Similarly, perpendicular force transmits a compressive force on the top of the elastomeric pads, which hold the elongate members together from the top, and a tensile force to the brackets, which hold the elongate members together from the bottom.

One skilled in the art understands that there are various methods for manufacturing elastomeric forms. In some embodiments the joint and support components are injection-molded. In other embodiments, elastomeric components may be manufactured by a low-pressure molding process using foamed urethane. In still other embodiments elastomeric components may be die-cut from stock material. One skilled in the art also understands that elastomeric components may be placed between frame members and a sub-floor.

Other objects and features will become apparent from the following detailed description considered in conjunction with the accompanying drawings. It is to be understood, however, that the drawings are designed as an illustration and not as a definition of the limits of the invention.

BRIEF DESCRIPTION OF THE DRAWINGS

To assist those of skill in the art in making and using the disclosed floor system and associated methods, reference is made to the accompanying figures, wherein.

DESCRIPTION

Figure 1:
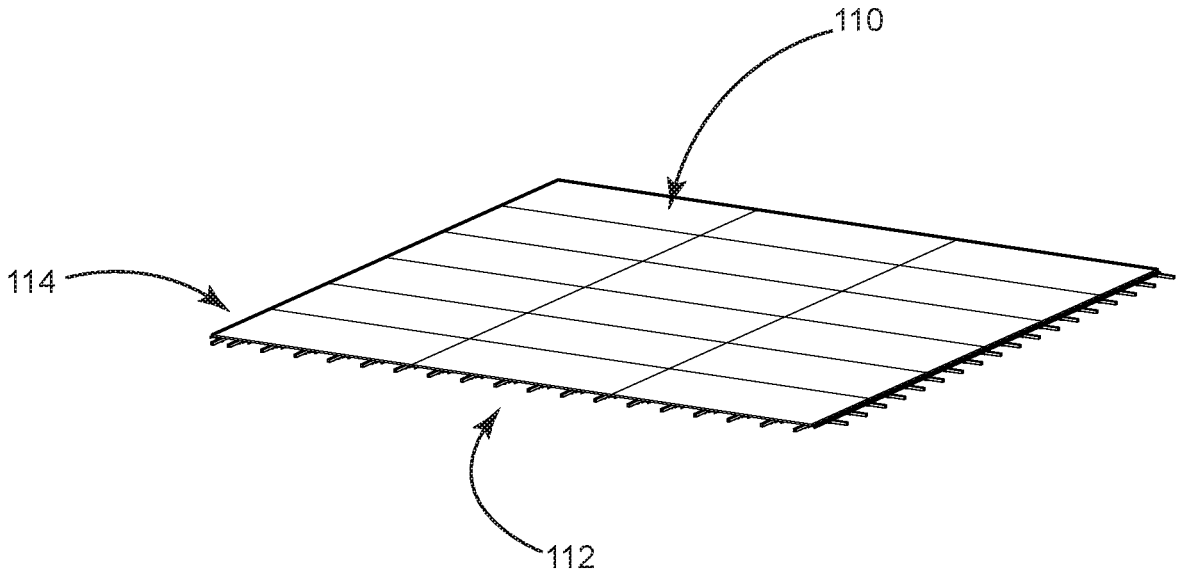
FIG. 1 is a perspective view of a complete modular floor assembly.

FIG. 1 shows a perspective view of the present embodiment. A modular sprung floor assembly 100 has a performance surface 110 fixed on a frame assembly 112. The frame assembly extends to meet the two edge assemblies 114. Although one edge assembly is depicted, one skilled in the art understands that edge assemblies may be joined with any or all edges of a sprung-floor assembly.

Figure 2:
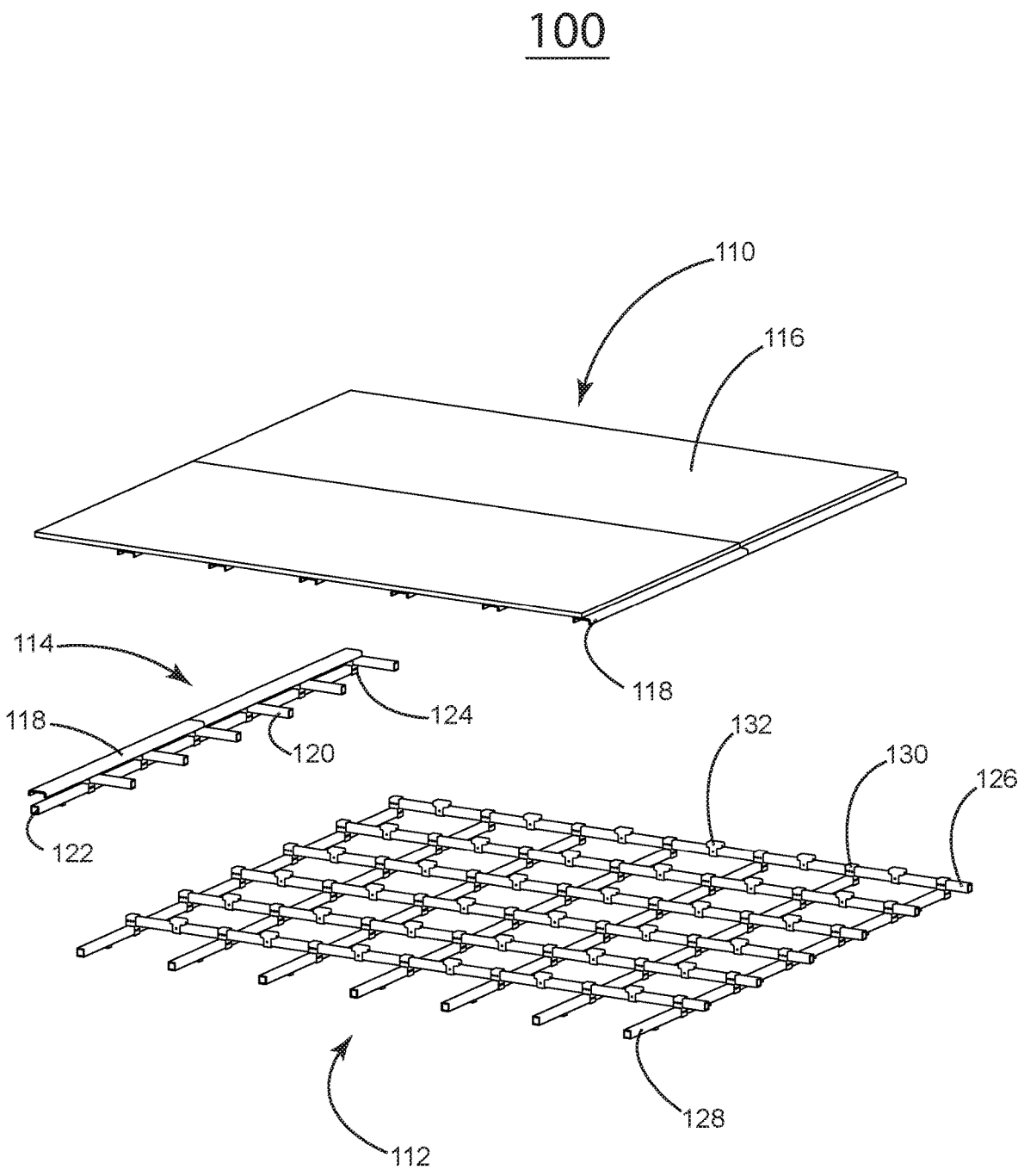
FIG. 2 is a perspective, partially exploded view of the embodiment of FIG. 1.

FIG. 2 shows a perspective, partially exploded view of the embodiment of FIG. 1, 100. The performance surface 110 is made up of a plurality of surface panels 116 which are fastened together on their undersides by perpendicularly placed lateral channels 118. A frame assembly 112 has X-axis members 126 and perpendicularly attached Y-axis members 128. Frame joints 130 are elastomeric forms that join X-axis members 126 and Y-axis members 128 at right angles, while damping vibration between members. Lateral channel supports 132 are elastomeric forms that join X-axis members 126 to the above lateral channels 118.

An edge assembly 114 attaches to the frame assembly 112 on at least two sides. The edge assembly comprises relatively long Y-axis members 122 co-linear with Y-axis frame members 128. Perpendicularly affixed to the edge assembly's Y-axis members 122 are relatively short X-axis members 120, which are co-linear with X-axis frame members 126.

The edge assembly's X- and Y-axis members 120, 122 are joined by edge-assembly joints 124. Edge-assembly joints are elastomeric in form and serve to absorb shock and damp vibrations between members. These edge-assembly joints further affix the X- and Y-axis members to an above lateral channel 118. Lateral channels 118 fasten together the above performance-surface panels 116.

Figure 3:
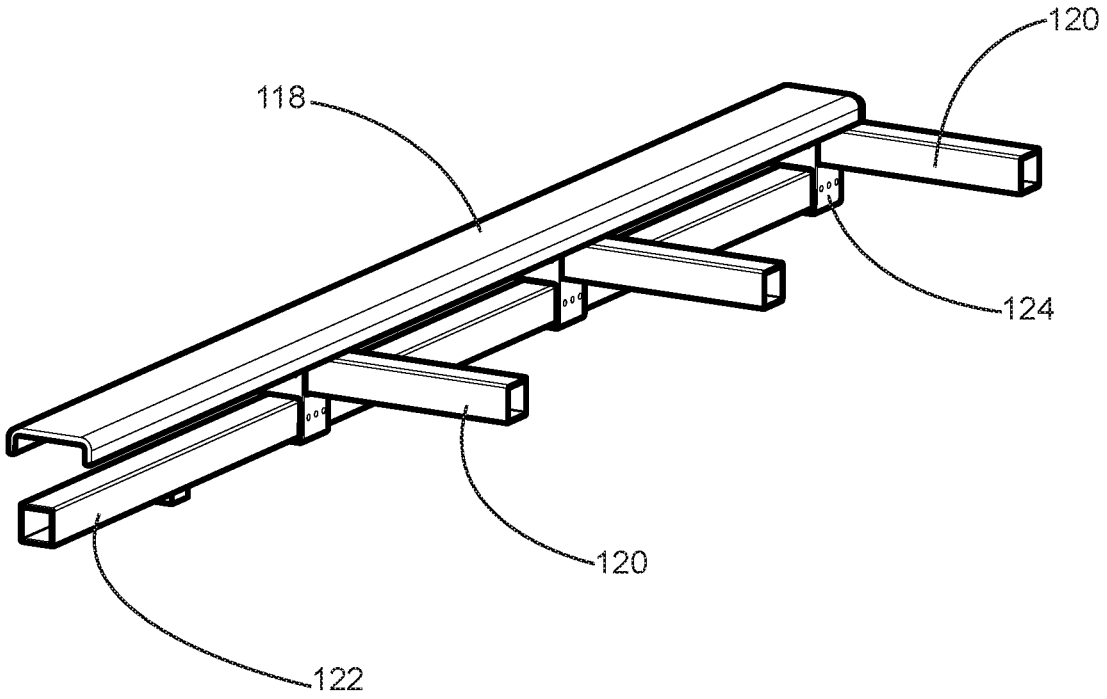
FIG. 3 is a perspective view depicting the edge assembly of the embodiment of FIG. 1.
Figure 4:
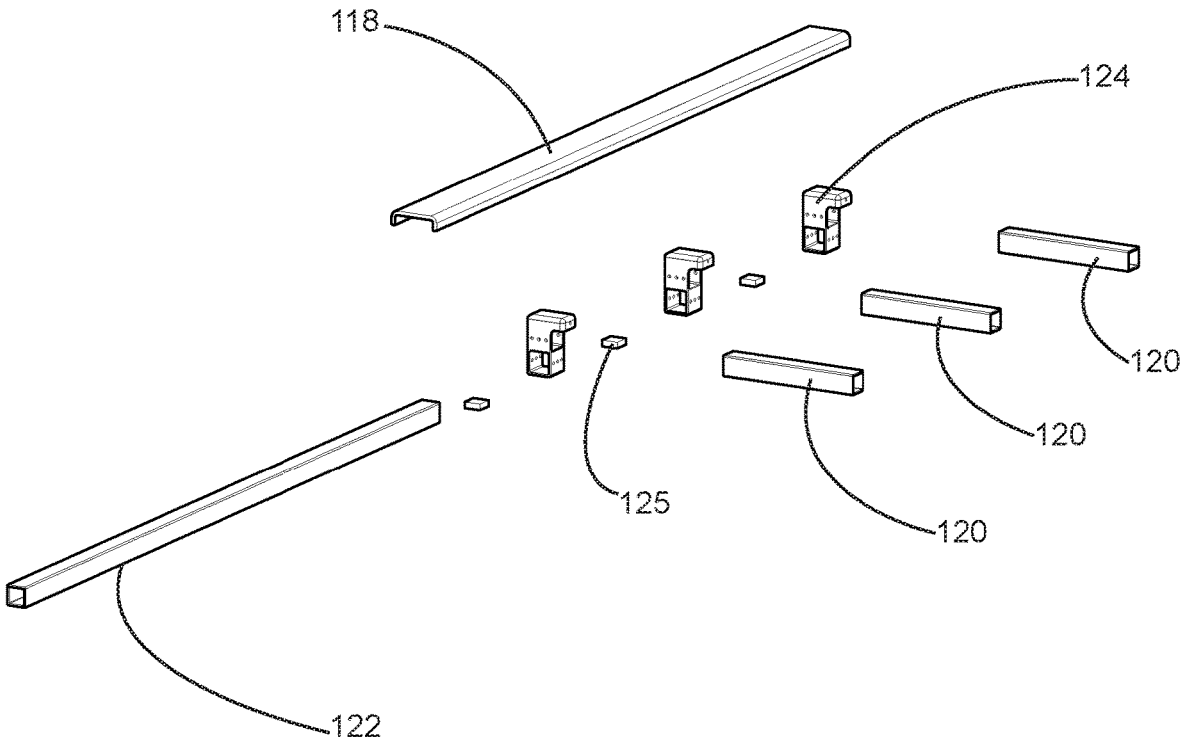
FIG. 4 is an exploded view of the edge assembly of FIG. 3.

FIGS. 3 and 4 illustrate an enlarged edge assembly and an exploded view of an edge assembly, respectively. The Y-axis member 122 is joined with relatively short X-axis members 120. Edge-assembly joints 124 are elastomeric forms that affix the X-axis and Y-axis members and also fasten those members to an above lateral channel 118, while damping vibrations between members. In some embodiments, mounting pads 125 reside beneath Y-axis members 122 and provide vibration damping between Y-axis members and a sub-floor.

Figure 5:
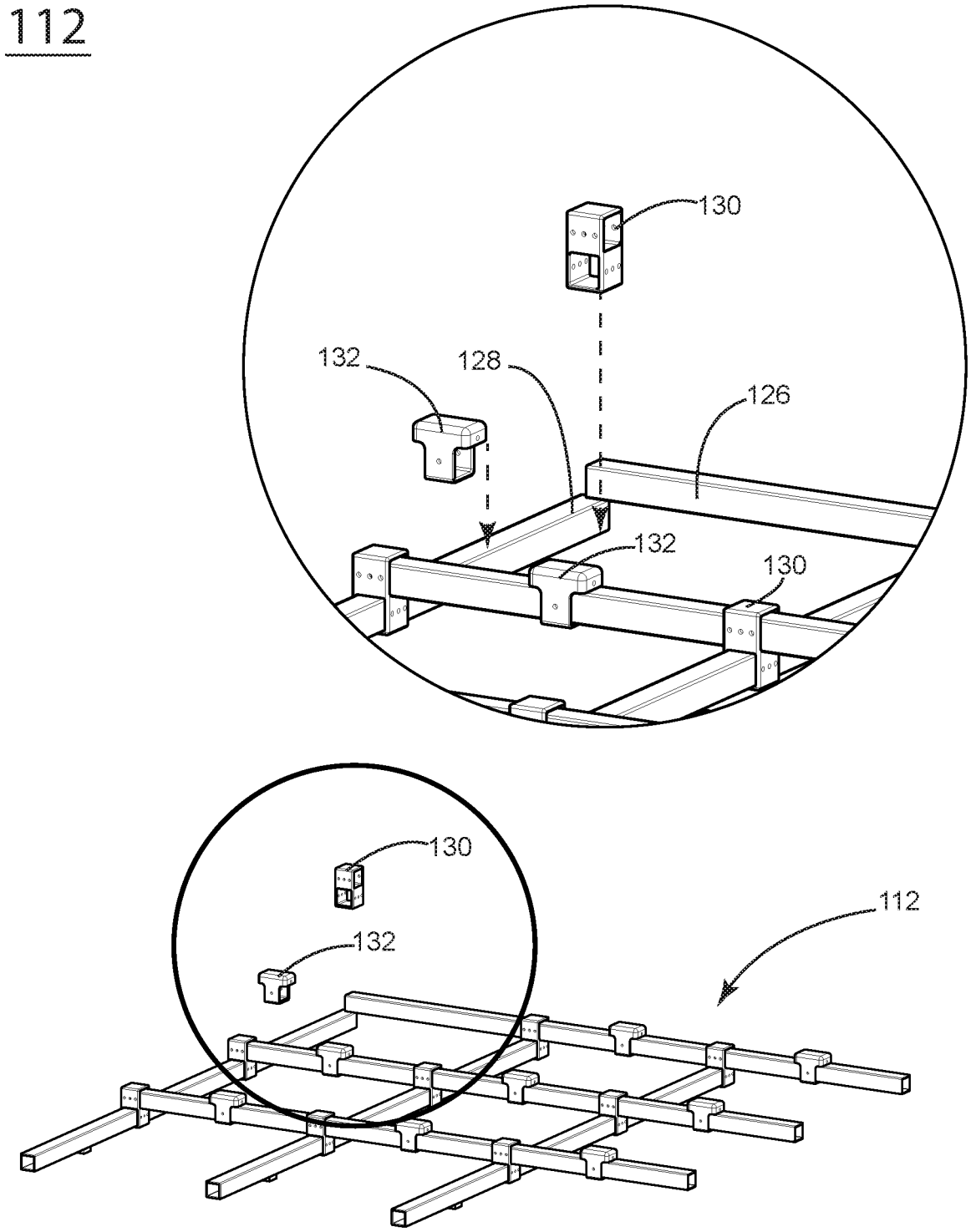
FIG. 5 is a partially exploded, detail view of the frame portion of the embodiment of FIG. 1.

FIG. 5, 112 is an exploded view and an exploded detail view of the frame assembly 112 with elastomeric joints 130 connecting X-axis members 126 to Y-axis members 128. Through-holes in the elastomeric, lateral-channel supports 132 fixedly engage X-axis members 126 with Y-axis members 128.

Figure 6:
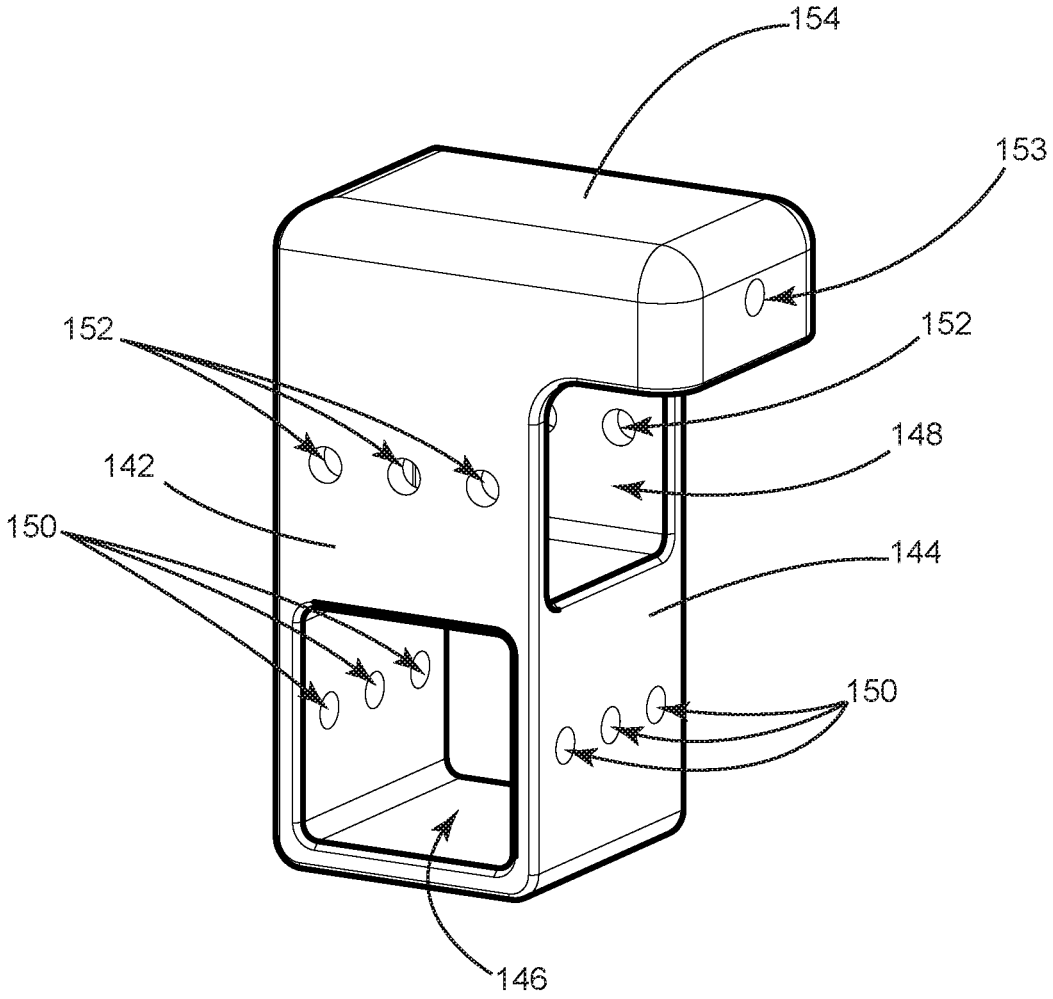
FIG. 6 is a perspective view of a joint of the edge assembly of FIG. 3 and FIG. 4.

FIG. 6 is a perspective view of an edge-assembly joint 124 with a top surface 154, a left-side surface 142 and a front surface 144. In some embodiments left and right sides are substantially symmetrical as are front and back surfaces. The top surface 154 overlaps the front surface 144. In other words the top surface 154 is larger than the cross-sectional area that is defined by left-side surface 142 and front surface 144. The top surface is configured to engage with a lateral channel 118 (FIG. 2). A through-hole 146 is configured to accept Y-axis members 122 (FIG. 4) of the edge assemblies. Through-hole 148 is configured to accept X-axis members 120 of the edge assemblies. Fastener-holes FIG. 6, 150 allow for fasteners to affix the edge-assembly joints 124 (FIG. 4) with Y-axis members 122 (FIG. 4). Fastener-holes FIG. 6 152 allow for fasteners to affix the edge-assembly joints 124 (FIG. 3) to lateral channels 118. One skilled in the art understands how an elastomeric form similar to edge assembly joint 124 may join linear, structural members at right angles while also joining lateral structural members, while also damping vibration between structural components.

Figure 7:
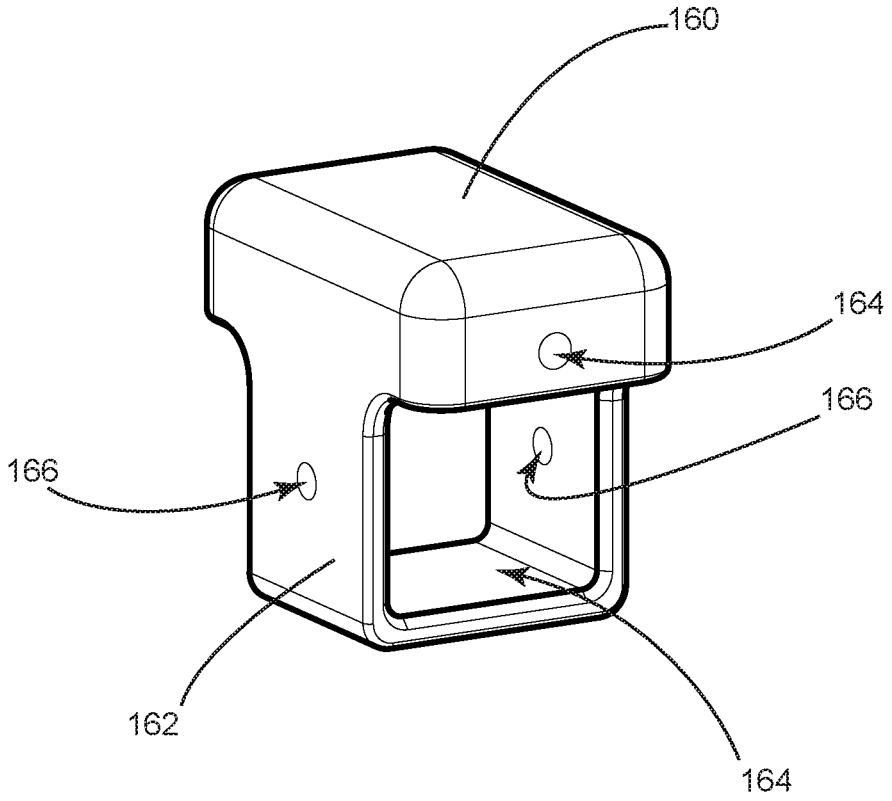
FIG. 7 is a perspective view of a channel support of the embodiment depicted in FIG.

FIG. 7 depicts an example lateral-channel support 132 with a top surface 160 and side surfaces 162. A through-hole 164 is configured to accept Y-axis frame members (FIGS. 2, 5). Fastener holes 166 allow fasteners to affix lateral channels with Y-axis members.

Figure 8:
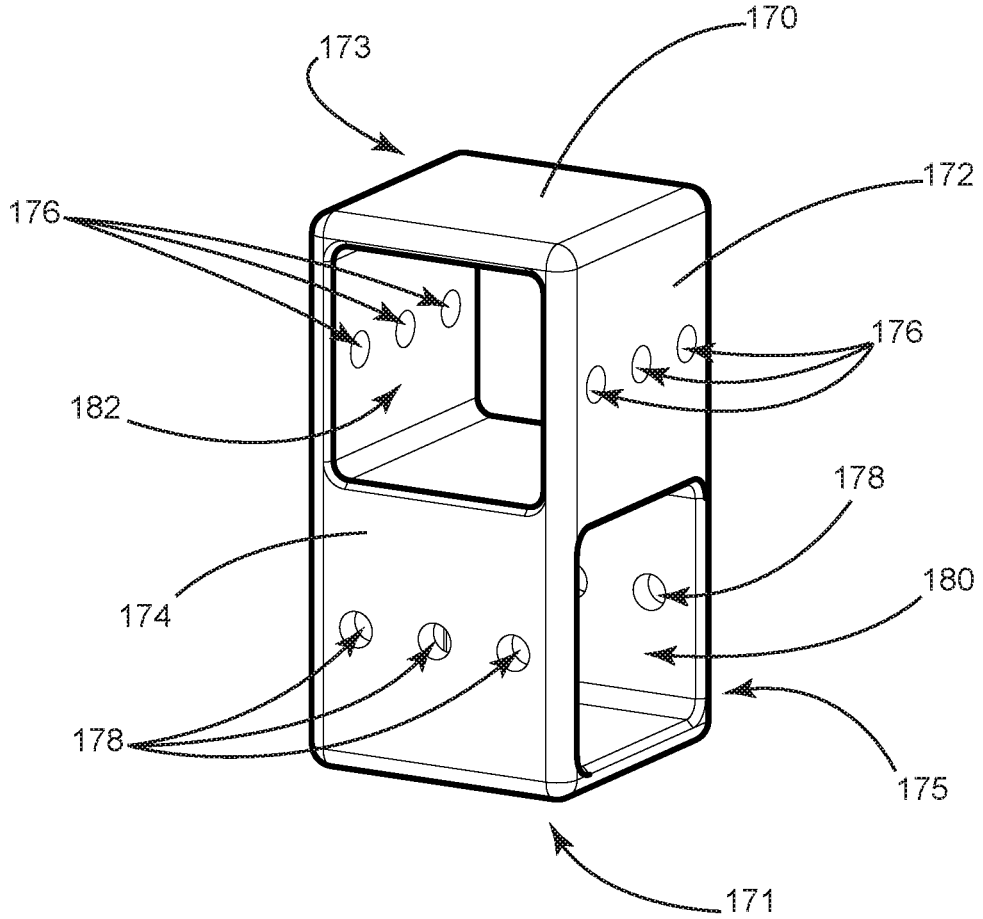
FIG. 8 is a perspective view of a joint of the embodiment depicted in FIG. 5.

FIG. 8 shows a frame joint 130 which connects X-axis members and Y-axis members at right angles, one atop the other, through through-holes 182 and 180. The frame joint 130 has a top surface 170 that is substantially symmetrical to a bottom surface 171. The frame joint 130 also has a front surface 172 that is substantially symmetrical to a rear surface 173. Similarly, a left-side surface 174 is substantially symmetrical to a right-side surface 175.

Fastener-holes 176 are configured to affix the frame joint 130 with X-axis members 126 (FIG. 2). Fastener-holes 178 are configured to allow fasteners to affix the frame joint 130 with Y-axis members 128 (FIG. 2).

Frame joints FIG. 8 130, lateral channel supports 132 (FIG. 5) and edge lateral channel supports 124 (FIG. 4) are made of a flexible material capable of damping vibration. One skilled in the art is familiar with injection-moldable, elastomeric material that may be consistently manufactured in appropriate forms and durometer to support the functional aspects of the aforementioned embodiments. One skilled in the art also understands that other manufacturing processes may be employed, including die-cutting, water-jet cutting or other subtractive processes and the like.

Figure 9:
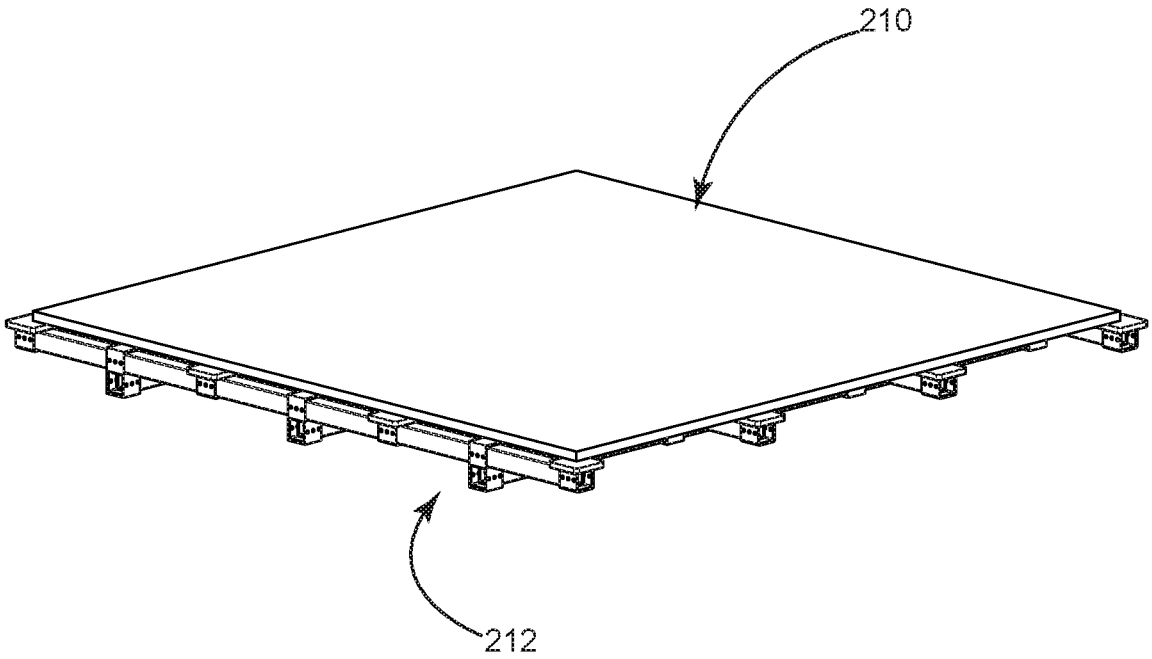
FIG. 9 is a perspective view of a second iteration of the embodiment.

In FIG. 9, a perspective view shows a second iteration 200 with a performance surface 210 resting atop a frame assembly 212.

Figure 10:
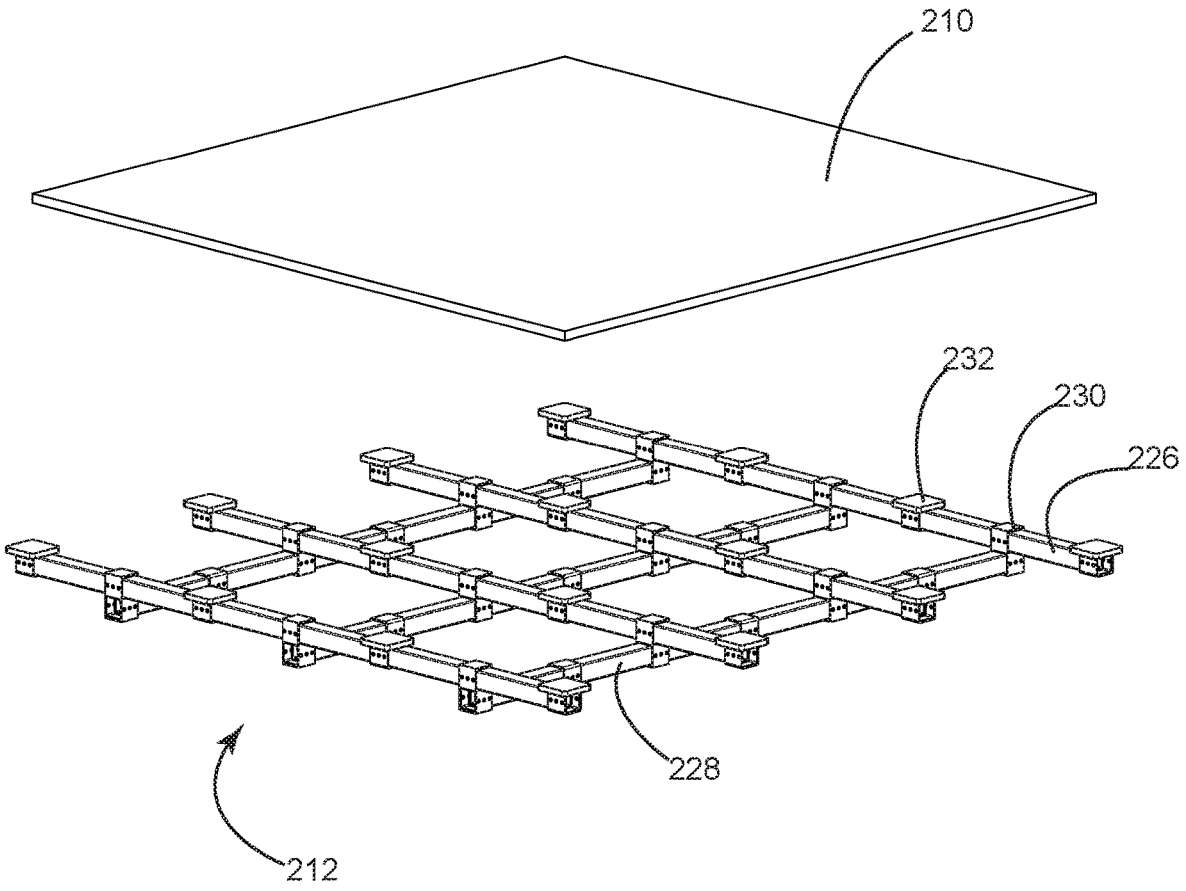
FIG. 10 is a perspective, partially exploded view of the embodiment of FIG. 9.

In FIG. 10, 200 Frame joints 230 connect X-axis members 226 and Y-axis members 228 at right angles, one atop the other, in the frame assembly 212. The performance surface 210 rests atop a frame assembly 212.

Figure 11:
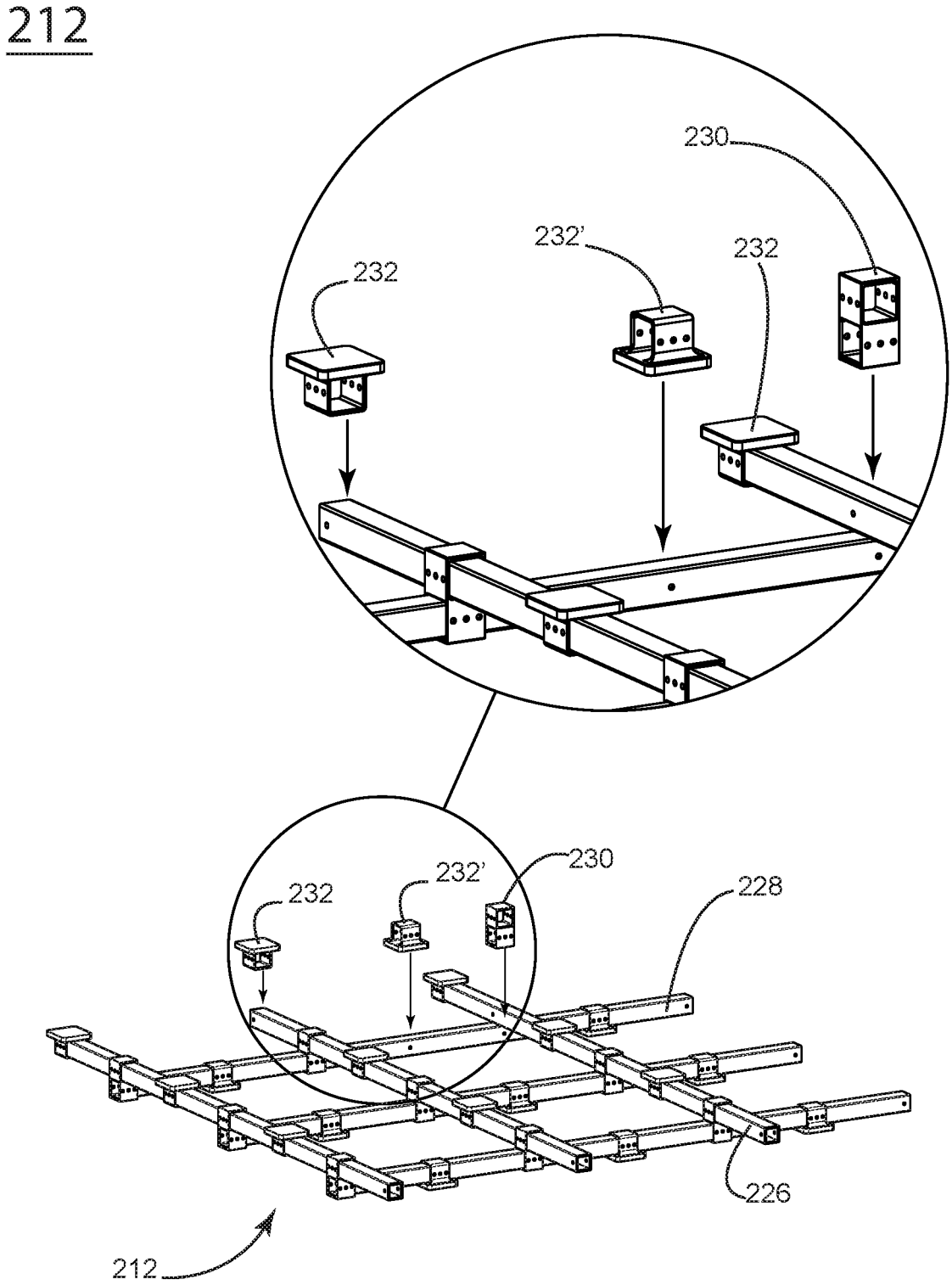
FIG. 11 is a partially exploded, detail view of the frame portion of the embodiment of FIG. 9.

FIG. 11, 212 shows a partially exploded detail view of the frame assembly. Frame joints 230 are elastomeric forms that join X-axis 226 and Y-axis members 228 at right angles, while damping vibration between members. Elastomeric pads 232 in their upright position support surface panels 116 (FIG. 2). Inverted, the elastomeric pads 232' support Y-axis cross members 228 and offset those members from a floor. One skilled in the art understands that the same part may be used for both purposes; in the example of elastomeric pads 232 and elastomeric pads 232' the same manufactured part is used in an upright orientation 232 and in an inverted orientation 232', performing different functions.

Figure 12:
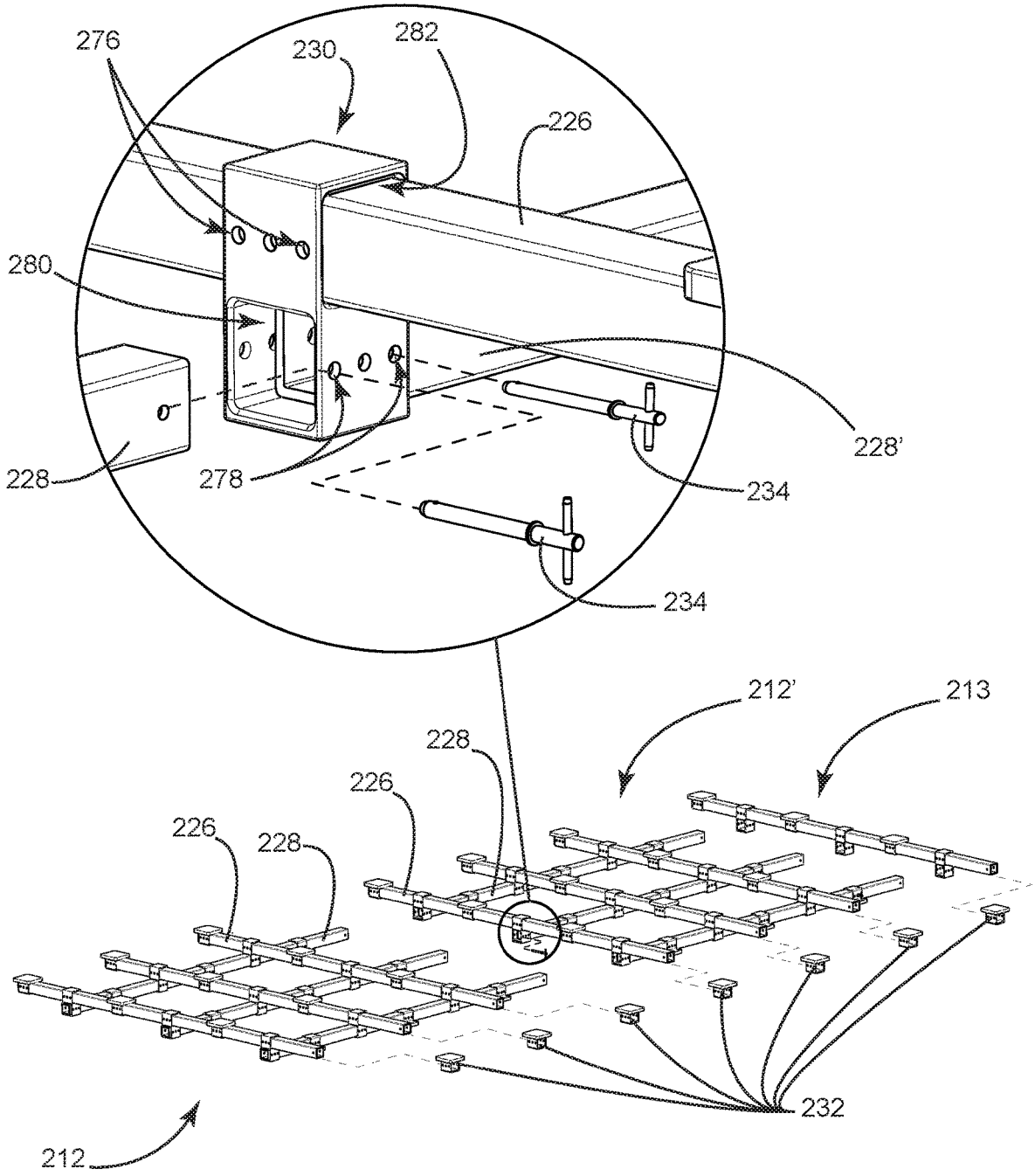
FIG. 12 is a detailed, perspective, exploded view of a frame joint of the embodiment depicted in FIG. 11.

In FIG. 12, two modules 212 and 212' are joined. The frame joint 230 is shown in an exploded view. The frame joint connects X-axis members 226 through through-holes 282 and Y-axis members 228 through through-holes 280, at right angles, one atop the other, in the frame assembly 212 and 212'. One skilled in the art understands that this assembly can be repeated to add more modules over a given area and to join Y-axis members through the pad fittings 232.

Fastener holes 276 are configured to affix the frame joint 230 to X-axis members 226 with the use of any generic fastener. Fastener holes 278 are configured to allow fasteners to affix the frame joint 230 with Y-axis members 228 or to butt-join two Y-axis members 228, 228' with the use of a pin 234. When a set of frame assemblies are joined, they are finished with a final X-member assembly 213 that has the same components as other X members in the assembly. One skilled in the art understands how the entire assembly can be completed with members 232 attached to open-ended members 226. One skilled in the art understands that in a similar manner X-axis members may be joined with pads 232.

Figure 13:
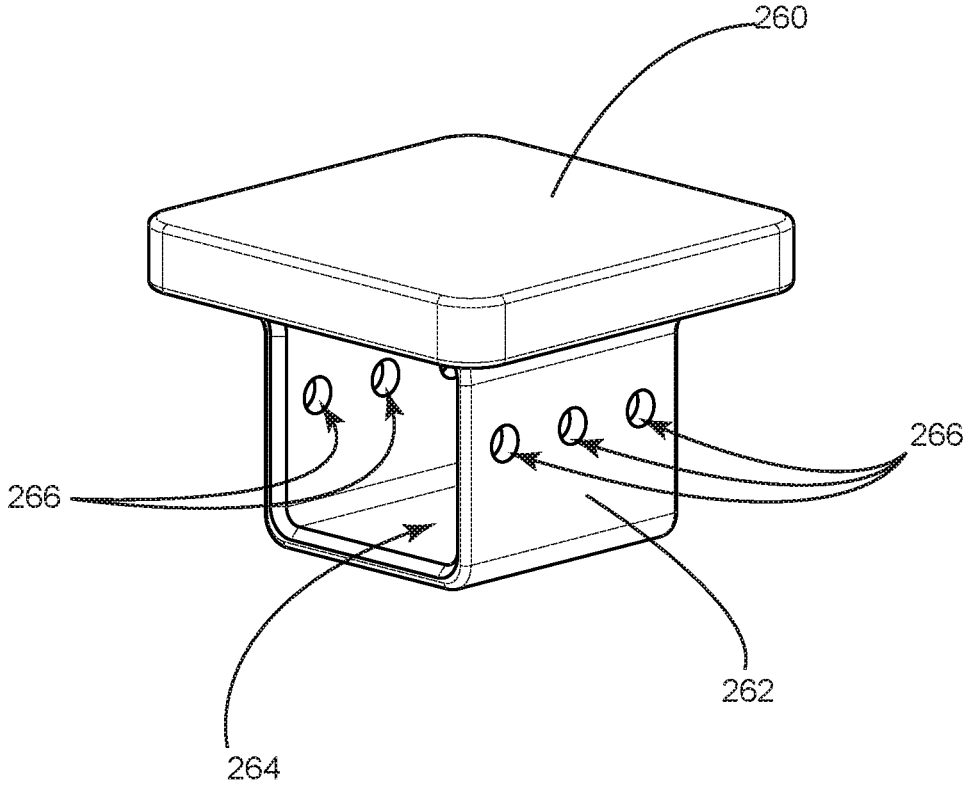
FIG. 13 is a perspective view of a performance-surface support, also referred to as a pad.

FIG. 13 shows a performance surface support, also known as a pad, 232 with a top surface 260 and side surfaces 262. Top surface 260 engages with a performance surface 210 (FIG. 9). A through-hole 264 is configured to accept X-axis frame members 226, (FIG. 11). Fastener-holes 266 allow fasteners to affix to X-axis members. One skilled in the art understands that 232 inverted (232') can be configured to affix to Y-axis members, and also to be used as a pad between the Y-axis members and a sub-floor.

Figure 14:
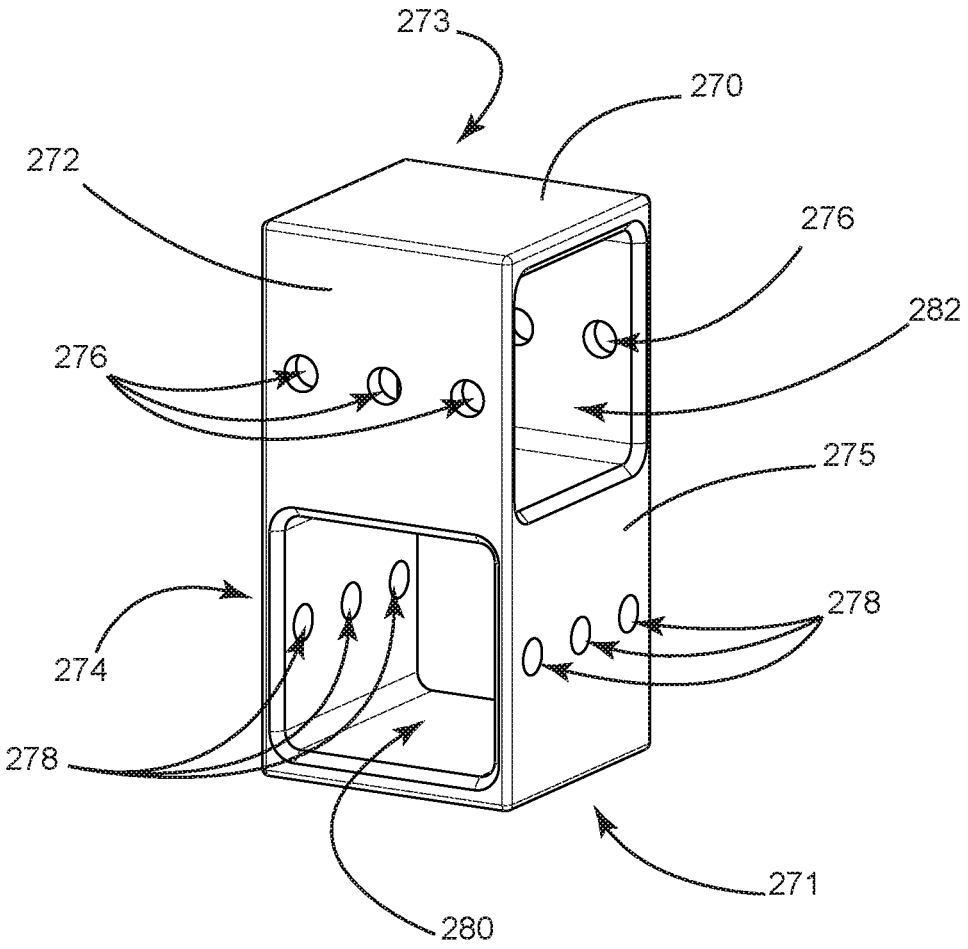
FIG. 14 is a perspective view of a frame joint.

FIG. 14 shows a frame joint 230 which connects X-axis members 226 (FIG. 12) through through-holes 282 and Y-axis members 228 (FIG. 12) through through-holes 280 at right angles, one atop the other, in the frame assembly. The frame joint 230 has a top surface 270 that is substantially symmetrical to a bottom surface 271. The frame joint 230 has a front surface 272 that is substantially symmetrical to a rear surface 273. Similarly, a left-side surface 274 is substantially symmetrical to a right-side surface 275. The frame joints 230 are made of a flexible material capable of damping vibration. One skilled in the art is familiar with injection-moldable elastomeric material that may be consistently manufactured in appropriate form and durometer to support the functional aspects of the aforementioned embodiments. One skilled in the art also understands that other manufacturing processes may be employed, including die-cutting, water-jet cutting or other subtractive processes and the like.

Fastener holes 276 are configured to affix the frame joint 230 to X-axis members 226 (FIG. 12) with the use of any generic fastener. Fastener holes 278 are configured to allow fasteners to affix the frame joint 230 with Y-axis members 228 (FIG. 12) or to butt-join two Y-axis members 228 (FIG. 12).

Figure 15:
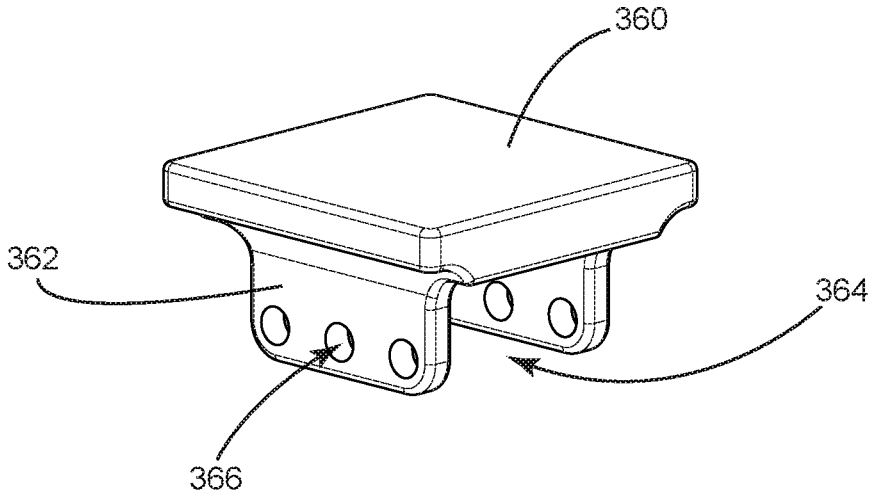
FIG. 15 is a perspective view of another iteration of a pad (performance-surface support).
Figure 17:
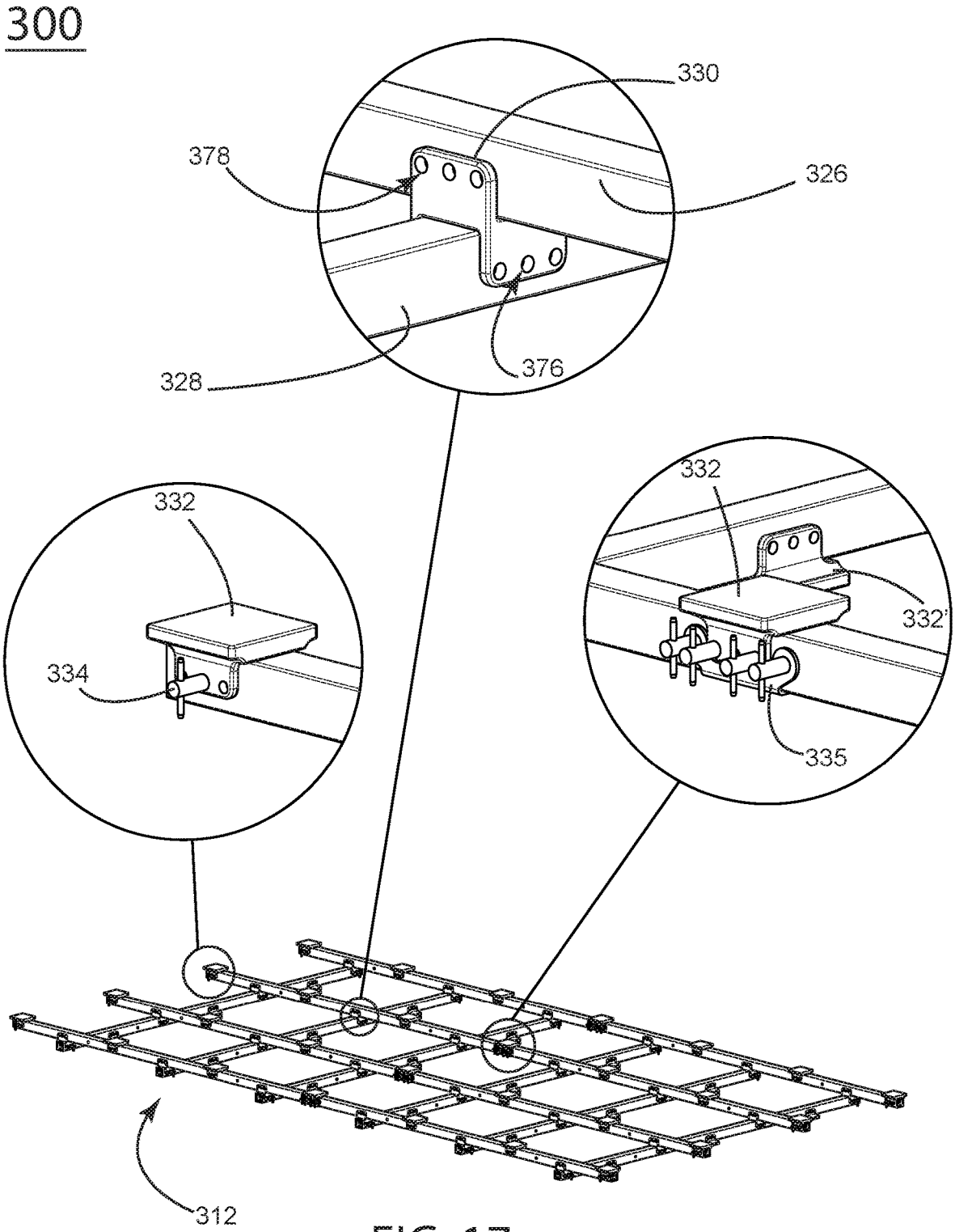
FIG. 17 is a perspective, detailed view of the pad of FIG. 15 and the frame joint of FIG. 16 shown installed on the assembly.

FIG. 15 is a perspective view of another iteration of a performance-surface support or pad 332 with a top surface 360 and side surfaces 362. Top surface 360 is designed to engage with a performance surface. A channel 364 is configured to accept X-axis frame members 326, (FIG. 17). Fastener-holes 366 allow fasteners to affix to X-axis members. One skilled in the art understands that 332 inverted (332') can be configured to affix to Y-axis members, and also to be used as a pad between the Y-axis members and a sub-floor.

Figure 16:
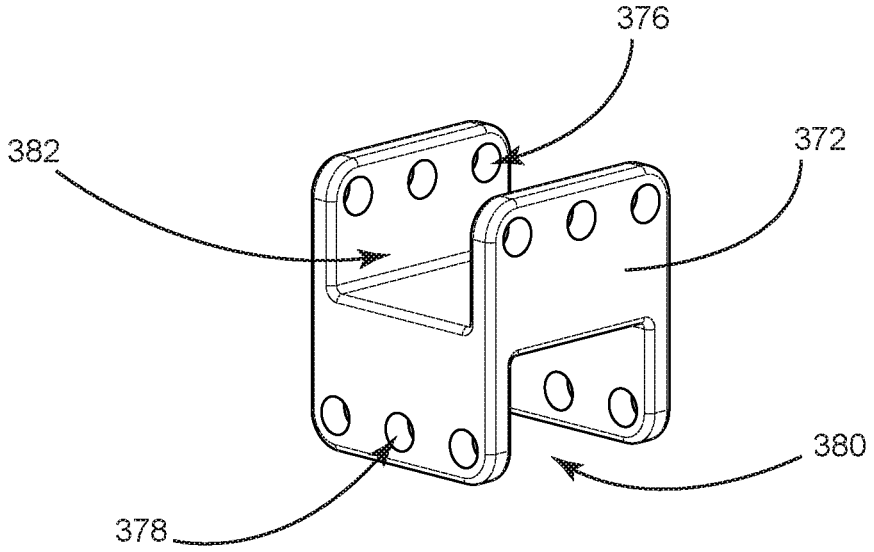
FIG. 16 a perspective view of is another iteration of a frame joint.

FIG. 16 shows a frame joint 330 which connects X-axis members and Y-axis members at right angles, one atop the other, in the frame assembly (FIG. 17). The frame joint 330 has a channel 382 which is parallel to a front surface 372 and is configured to engage with X-axis members 326 (FIG. 17). Channel 380 is configured to accept Y-axis frame members 328 (FIG. 17). Fastener-holes 376, 378 allow fasteners to affix to X-axis members and Y-axis members respectively.

FIG. 17, 300 shows the pad 332 of FIG. 15 and the frame joint 330 of FIG. 16 installed on a performance surface structural support assembly 300. Elastomeric pads 332 in their upright position support surface panels similar to surface panels 116 (FIG. 2). One skilled in the art understands the various types of laminate material that may be used as a performance surface. Inverted, the elastomeric pads 332' support Y-axis cross members 328 and offset those members from a sub-floor. One skilled in the art understands that the same part may be used for both purposes; in the example of elastomeric pads 332 and elastomeric pads 332' the same manufactured part is used in an upright orientation of the pad 332 and in an inverted orientation of the pad 332,' performing different functions (one adheres the grid structure to the performance surface while damping vibrations, and the other damps vibrations against a sub-floor). The frame joint 330 accepts X axis members 326 and Y axis members 328 at right angles.

A bracket 335 has an inverted U-shaped cross-section. It serves to join the x-axis frame members end to end. At least one pin 334 may be used to fasten the bracket 335 to a frame member 326.

Fastener holes 376 are configured to affix the frame joint 330 to X-axis members 326 with the use of common fasteners. Fastener holes 378 are configured to affix the frame joint 330 to Y-axis members 328.

Figure 18:
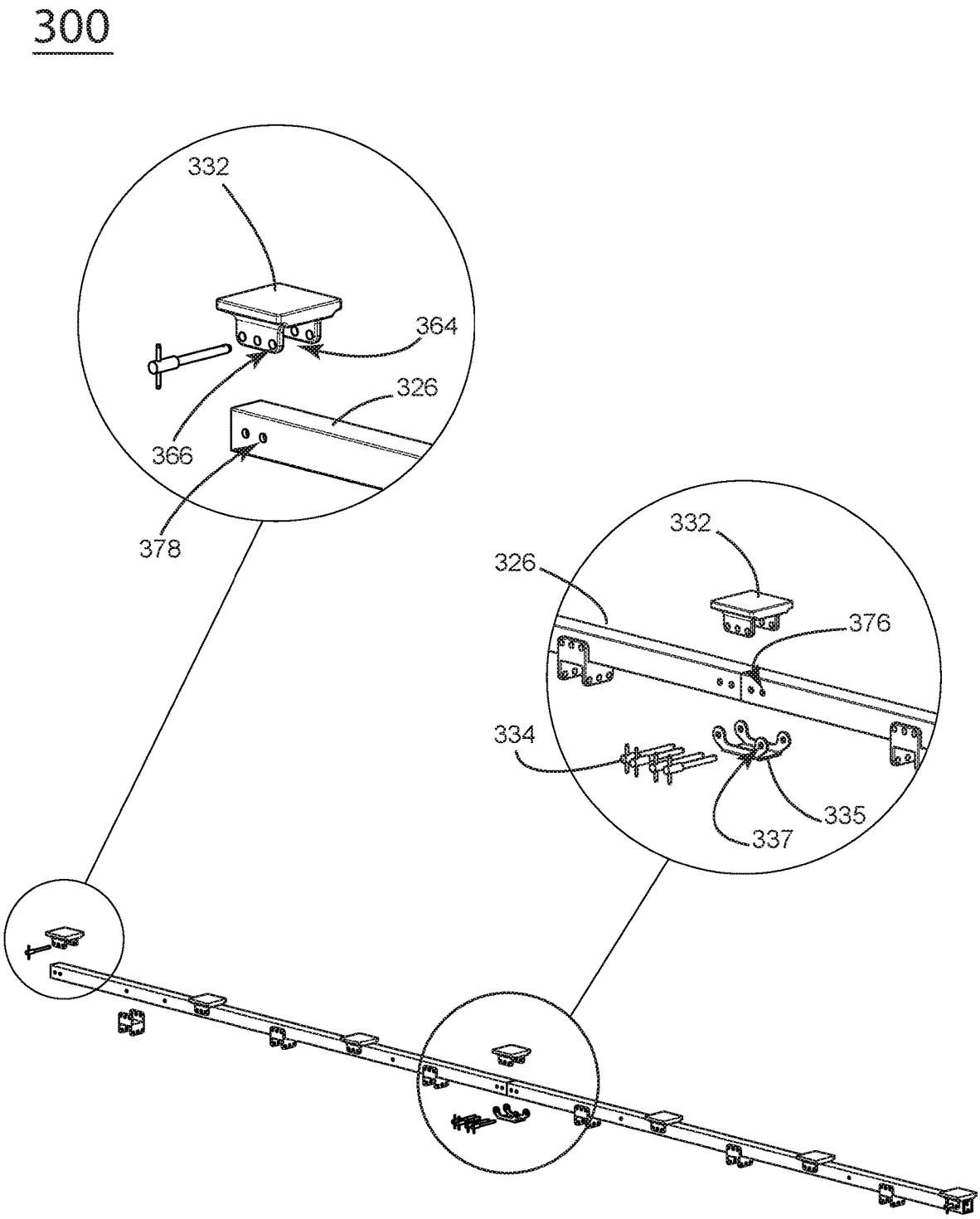
FIG. 18 is a perspective, detailed and partially exploded view of the pad shown installed on the assembly.

FIG. 18 illustrates how the elastomeric pads 332 install on the frame assembly. In their upright position the pads support surface panels of a sprung floor. One skilled in the art understands that this grid structure may support a performance surface of a sprung-floor assembly similar to that of FIG. 2.

A bracket 335 has an inverted U-shaped cross-section. It serves to join the x-axis frame members 326 end to end. Fastener holes 337 through the bracket 335 match those 376 of the frame members 326. At least one pin 334 may be used to fasten the bracket 335 to a frame member 326. Fastener holes 337 in the pad 332 match those 376 of the frame members and may be used to fortify this joint. Perpendicular force transmits a tensile force to the brackets, which hold the elongate members together from the bottom.

The invention claimed is:

1. A modular grid structure for a sprung-floor comprising:

at least two elongate members parallel to an X-axis; and at least two elongate members parallel to a Y-axis and perpendicular to said X-axis; and at least two elastomeric pads, each having a planar surface portion; and a channel; and said at least two elastomeric pads fixedly engaged through said channel, in an upright orientation, with said elongate members parallel to the X-axis; and said at least two elastomeric pads fixedly engaged through said channel, in an inverted orientation, with said elongate members parallel to the Y-axis; and at least two frame joint members having at least a first joint channel and a second joint channel; and said first and second joint channels being perpendicular to each other; and said elongate members parallel to the X-axis fixedly engaged through said first joint channel; and said elongate members parallel to the Y-axis fixedly engaged through said second joint channel in said joint member; wherein;

said planar surface portion of said at least two elastomeric pads which are fixedly engaged, in an inverted orientation, with said elongate members parallel to the Y-axis being movably engaged with a sub-floor; and said planar portion of said at least two elastomeric pads which are fixedly engaged, in an upright orientation, with said elongate members parallel to the X-axis being fixedly engaged with an upper floor surface that substantially covers said modular grid structure, providing a sprung-floor.

2. The modular grid structure of claim 1 further comprising:

at least two elongate members to be joined end-to-end; and a bracket for joining the ends of elongate members, the bracket comprising:

an inverted U-shaped cross section; and at least two through holes through said U-shaped cross section; wherein the bracket is engaged under the ends of a pair of elongate members, fasteners penetrate said through holes and said elongate members fixedly engaging said elongate members end-to-end.

3. The modular grid structure of claim 1 further comprising:

a first modular grid structure residing upon a sub-floor comprising:

at least four elongate members parallel with said X-axis are engaged with said frame joint members which are in turn engaged with at least four of said elongate members parallel to said Y-axis providing a first modular grid structure; and said at least four elongate members parallel to said Y-axis are each engaged, at one end, with a bracket, the brackets comprising:

inverted U-shaped cross sections; and at least two through holes through said inverted U-shaped cross sections; and providing a second grid structure residing upon a sub-floor; wherein at least four elongate members of said second grid structure, parallel to said Y-axis are engaged, at one end, with said brackets which are engaged with said first modular grid structure elongate members parallel to said Y-axis; wherein multiple modular grid structures provide a structure residing upon a sub-floor for supporting a sprung-floor.

4. The modular grid structure of claim 1 wherein:

the upper floor surface that substantially covers said modular grid structure is comprised of laminated wood.

* * * * *